US009854354B2

(12) United States Patent
Despotuli

(10) Patent No.: US 9,854,354 B2
(45) Date of Patent: Dec. 26, 2017

(54) MOBILE DEVICE WITH INCREASED SCREEN AREA

(71) Applicant: Leonid Despotuli, Chernogolovka (RU)

(72) Inventor: Leonid Despotuli, Chernogolovka (RU)

( * ) Notice: Subject to any disclaimer, the term of this patent is extended or adjusted under 35 U.S.C. 154(b) by 16 days.

(21) Appl. No.: 14/979,575

(22) Filed: Dec. 28, 2015

(65) Prior Publication Data

US 2017/0188139 A1 Jun. 29, 2017

(51) Int. Cl.
*H04R 1/34* (2006.01)

(52) U.S. Cl.
CPC ..... *H04R 1/345* (2013.01); *H04R 2499/11* (2013.01)

(58) Field of Classification Search
None
See application file for complete search history.

(56) References Cited

U.S. PATENT DOCUMENTS 8,934,228 B2 * 1/2015 Franklin ..... G06F 1/1652 361/679.26
9,092,204 B2 * 7/2015 Chou ..... G06F 1/203
9,319,760 B2 * 4/2016 Goel ..... H04R 1/02
2002/0052216 A1 * 5/2002 Song ..... H04M 1/0202 455/569.1
2004/0131202 A1 * 7/2004 Cranfill ..... H04M 1/035 381/89
2005/0233781 A1 * 10/2005 Erixon ..... H04M 1/035 455/575.1
2008/0149417 A1 * 6/2008 Dinh ..... H04M 1/03 181/145
2010/0046771 A1 * 2/2010 Gregg ..... H04R 1/02 381/98
2010/0091439 A1 * 4/2010 Horii ..... H04M 1/0249 361/679.01
2013/0279730 A1 * 10/2013 Tanaka ..... H04R 1/021 381/333

* cited by examiner

*Primary Examiner* — Paul Huber
(74) *Attorney, Agent, or Firm* — TransPacific Law Group; Pavel I. Pogodin, Esq.

(57) ABSTRACT

Described is a novel smartphone design with increased area of the front face occupied by the screen. The smartphone includes a smartphone body or housing, which houses all the smartphone components. A smartphone screen is disposed towards the front face of the smartphone body or housing. An internal smartphone speaker is located entirely or substantially behind the smartphone screen. Sound generated by the smartphone speaker is guided towards a linear sound opening on the front face of the smartphone using a sound channel or sound guide. The smartphone speaker opening in the front face of the smartphone is substantially thin (for example 1 mm) and extends substantially across the entire width of the smartphone immediately above the top edge of the smartphone screen. Using this smartphone design, the area of the smartphone's front face occupied by the screen may be maximized.

18 Claims, 8 Drawing Sheets

MOBILE DEVICE WITH INCREASED SCREEN AREA

BACKGROUND OF THE INVENTION

Technical Field

The disclosed embodiments relate in general to mobile device design, more specifically, to a mobile device with increased screen area.

Description of the Related Art

The latest trend in smartphone design is reduction of the phone body bezel around the screen. However, the conventional smartphones still retain significant unused (by the screen) area on the top of the phone's body. This is dictated by the need to accommodate the built-in speaker of the smartphone such that the sound generated by it is directed towards the ear of the phone's user. This requires the placement of the built-in speaker towards the front face of the smartphone, while the smartphone's screen has to be placed below the speaker opening on the front face.

As would be appreciated by persons of ordinary skill in the art, in view of the above and other deficiencies of the conventional approach, a new and improved smartphone design that would maximize the area of the front face of the smartphone occupied by the screen would be highly desirable.

SUMMARY OF THE INVENTION

The embodiments described herein are directed to methods and systems that substantially obviate one or more of the above and other problems associated with conventional approach to mobile device layout.

In accordance with one aspect of the inventive concepts described herein, there is provided a smartphone comprising: a housing comprising a front face, the front face comprising a sound opening; a screen disposed on the front face of the housing; an integrated speaker disposed substantially behind the screen; and a sound guide connecting the integrated speaker with the sound opening, wherein the sound opening is linear, wherein the sound opening is located immediately above a top edge of the screen and wherein the screen occupies substantially entire area of an upper portion of the front face of the housing.

In one or more embodiments, the sound opening extends substantially across entire width of the smartphone.

In one or more embodiments, the housing further comprises an upper side, the upper side comprising a second sound opening and wherein the smartphone further comprises a second sound guide connecting the integrated speaker with the second sound opening.

In one or more embodiments, the screen occupies substantially entire area of the front face of the housing.

In accordance with another aspect of the inventive concepts described herein, there is provided a smartphone comprising: a housing comprising a front face and an upper side, the upper side comprising a sound opening; a screen disposed on the front face of the housing; an integrated speaker disposed substantially behind the screen; and a sound guide connecting the integrated speaker with the sound opening, wherein the screen occupies substantially entire area of an upper portion of the front face of the housing.

In one or more embodiments, the sound opening extends substantially across entire width of the smartphone.

In one or more embodiments, the front face comprises a second sound opening and wherein the smartphone further comprises a second sound guide connecting the integrated speaker with the second sound opening.

In one or more embodiments, the screen occupies substantially entire area of the front face of the housing.

In accordance with yet another aspect of the inventive concepts described herein, there is provided a smartphone comprising: a housing comprising a front face and an upper side; a screen disposed on the front face of the housing; and an integrated speaker disposed substantially behind the screen and comprising a speaker membrane; wherein the speaker membrane is oriented towards the upper side of the housing and wherein the screen occupies substantially entire area of an upper portion of the front face of the housing.

In one or more embodiments, the integrated speaker extends substantially across entire width of the smartphone.

In one or more embodiments, the screen occupies substantially entire area of the front face of the housing.

In one or more embodiments, the upper side comprises a sound opening, the smartphone further comprising a sound guide connecting the integrated speaker with the sound opening.

In one or more embodiments, the front face comprises a sound opening, the smartphone further comprising a sound guide connecting the integrated speaker with the sound opening.

In one or more embodiments, the upper side comprises a first sound opening and the front face comprises a second sound opening, the smartphone further comprising a sound guide connecting the integrated speaker with the first and second sound opening.

In accordance with yet another aspect of the inventive concepts described herein, there is provided a smartphone comprising: a housing comprising a front face and an upper side; a screen disposed on the front face of the housing; and an integrated speaker comprising a speaker membrane and a speaker body, the speaker body being disposed substantially behind the screen, wherein the speaker membrane is wider than the speaker body, wherein the speaker membrane is disposed immediately above a top edge of the screen, wherein the speaker membrane is oriented towards the upper side of the housing and wherein the screen occupies substantially entire area of an upper portion of the front face of the housing.

In one or more embodiments, the integrated speaker extends substantially across entire width of the smartphone.

In one or more embodiments, the screen occupies substantially entire area of the front face of the housing.

In one or more embodiments, the upper side comprises a sound opening, the smartphone further comprising a sound guide connecting the integrated speaker with the sound opening.

In one or more embodiments, the front face comprises a sound opening, the smartphone further comprising a sound guide connecting the integrated speaker with the sound opening.

In one or more embodiments, the upper side comprises a first sound opening and the front face comprises a second sound opening, the smartphone further comprising a sound guide connecting the integrated speaker with the first and second sound opening.

Additional aspects related to the invention will be set forth in part in the description which follows, and in part will be obvious from the description, or may be learned by practice of the invention. Aspects of the invention may be realized and attained by means of the elements and combinations of various elements and aspects particularly pointed out in the following detailed description and the appended claims.

It is to be understood that both the foregoing and the following descriptions are exemplary and explanatory only and are not intended to limit the claimed invention or application thereof in any manner whatsoever.

BRIEF DESCRIPTION OF THE DRAWINGS

The accompanying drawings, which are incorporated in and constitute a part of this specification exemplify the embodiments of the present invention and, together with the description, serve to explain and illustrate principles of the inventive concepts. Specifically.

DETAILED DESCRIPTION

In the following detailed description, reference will be made to the accompanying drawing(s), in which identical functional elements are designated with like numerals. The aforementioned accompanying drawings show by way of illustration, and not by way of limitation, specific embodiments and implementations consistent with principles of the present invention. These implementations are described in sufficient detail to enable those skilled in the art to practice the invention and it is to be understood that other implementations may be utilized and that structural changes and/or substitutions of various elements may be made without departing from the scope and spirit of present invention. The following detailed description is, therefore, not to be construed in a limited sense. Additionally, the various embodiments of the invention as described may be implemented in the form of a software running on a general purpose computer, in the form of a specialized hardware, or combination of software and hardware.

To address the above and other problems associated with the conventional technology, one or more embodiments described herein implement an alternative approach to smartphone layout that is designed to maximize the area of the front face of the smartphone occupied by the screen.

Figure 1A:
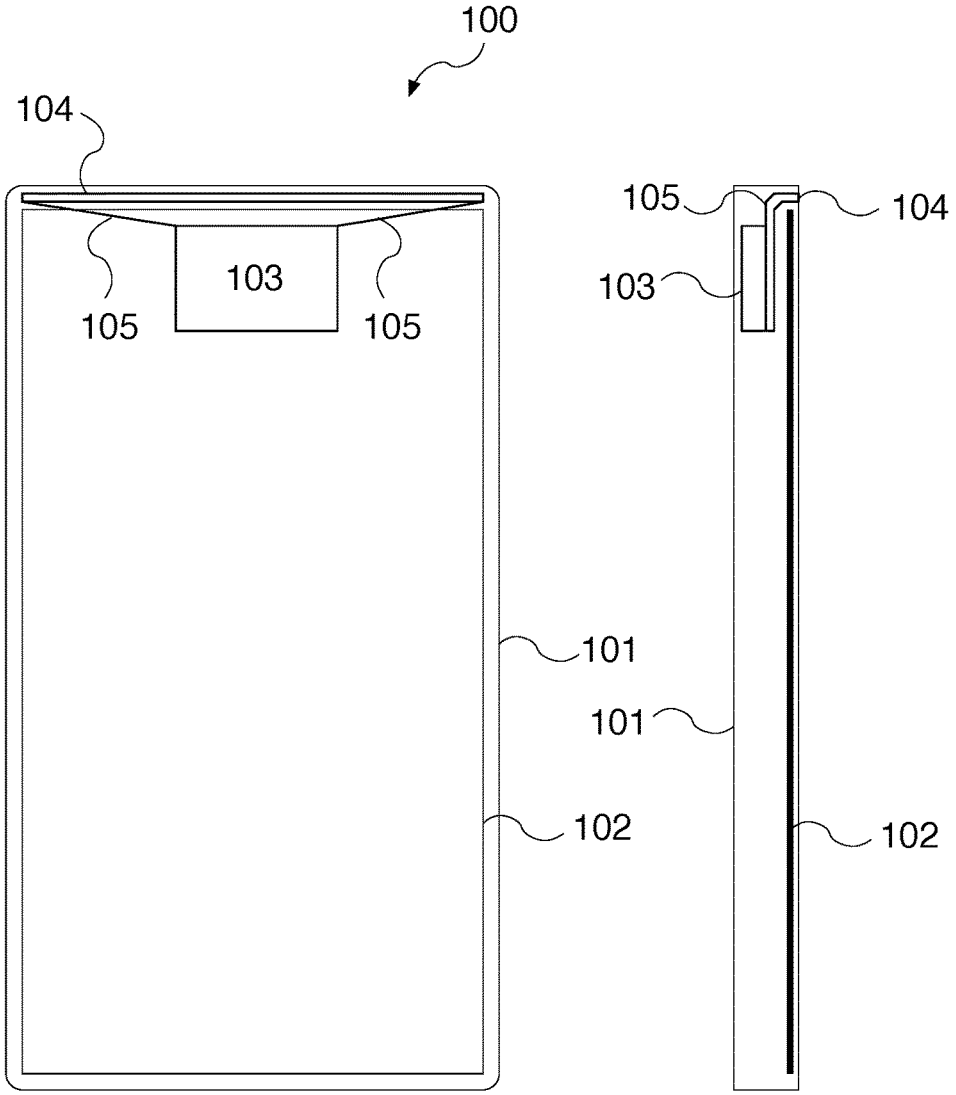
FIGS. 1(*a*) and 1(*b*) illustrate a first exemplary embodiment of a novel smartphone design with increased area of the front face occupied by the smartphone screen.
Figure 1B:
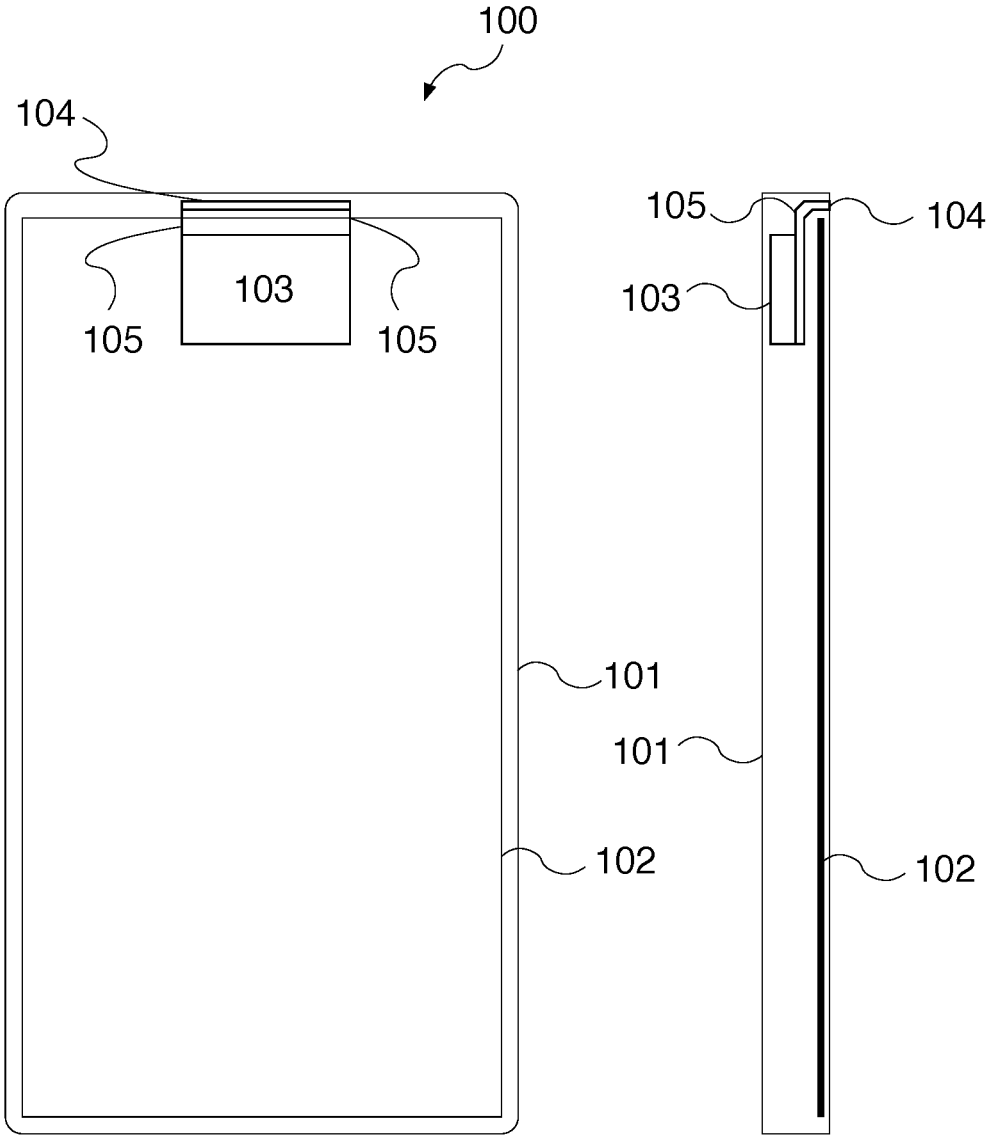

FIGS. 1(*a*) and 1(*b*) illustrate a first exemplary embodiment 100 of a novel smartphone design with increased area of the front face occupied by the screen. The shown embodiment 100 includes a smartphone body or housing 101, which houses all the smartphone components. A smartphone screen 102 is disposed towards the front face of the smartphone body or housing 101. An internal smartphone speaker 103 is located entirely or substantially behind the smartphone screen 102. Sound generated by the smartphone speaker 103 is guided towards a linear sound opening 104 on the front face of the smartphone 100 using a sound channel or sound guide 105. In one embodiment shown in FIG. 1(*a*), the smartphone speaker opening 104 in the front face of the smartphone is substantially thin (for example 1 mm) and extends substantially across the entire width of the smartphone 100 immediately above the top edge of the smartphone screen 102. In alternative embodiment shown in FIG. 1(*b*), the speaker opening 104 has the width of the speaker. As would be appreciated by persons of ordinary skill in the art, using this smartphone design, the area of the smartphone's front face occupied by the screen 102 may be maximized.

Figure 2A:
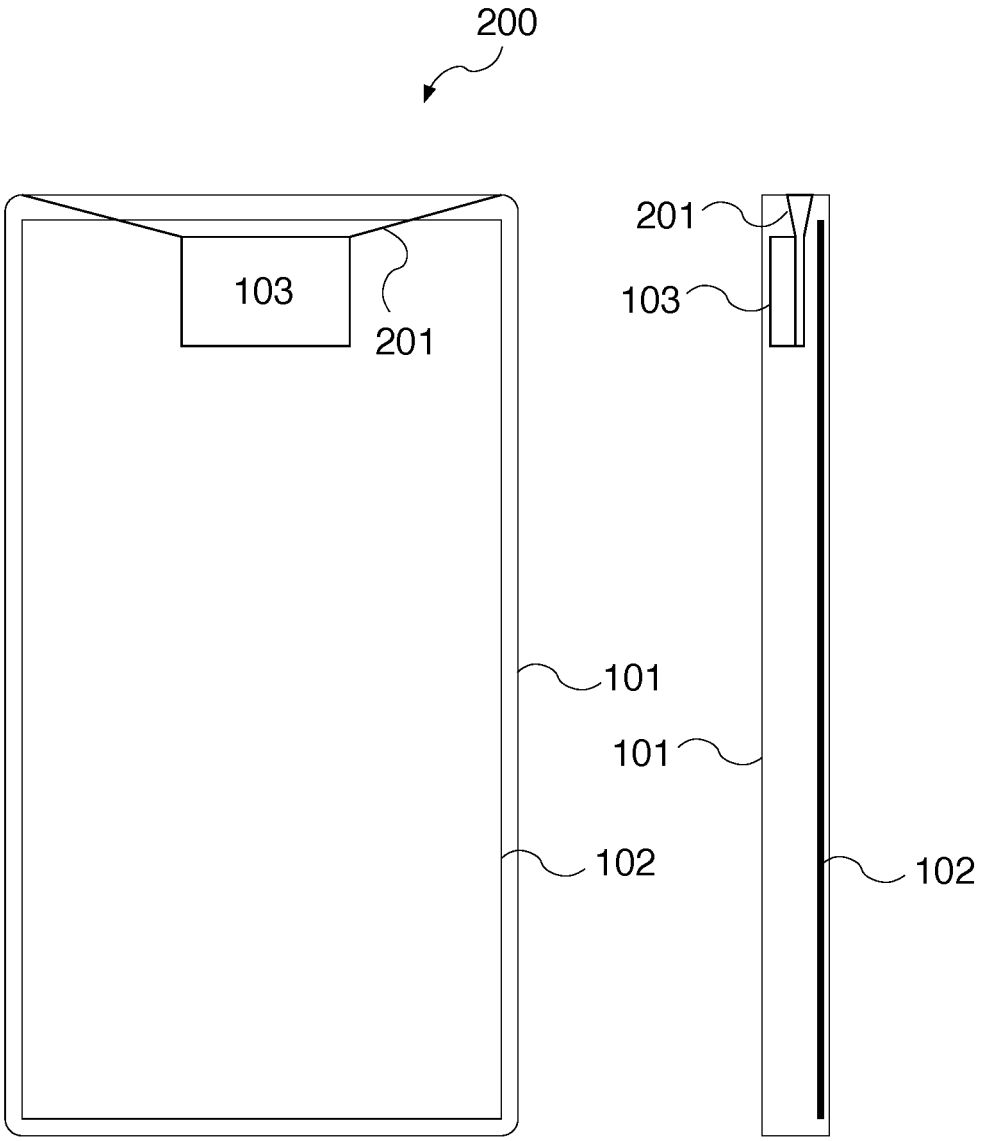
FIGS. 2(*a*) and 2(*b*) illustrates a second exemplary embodiment of a novel smartphone design with increased area of the front face occupied by the smartphone screen.
Figure 2B:
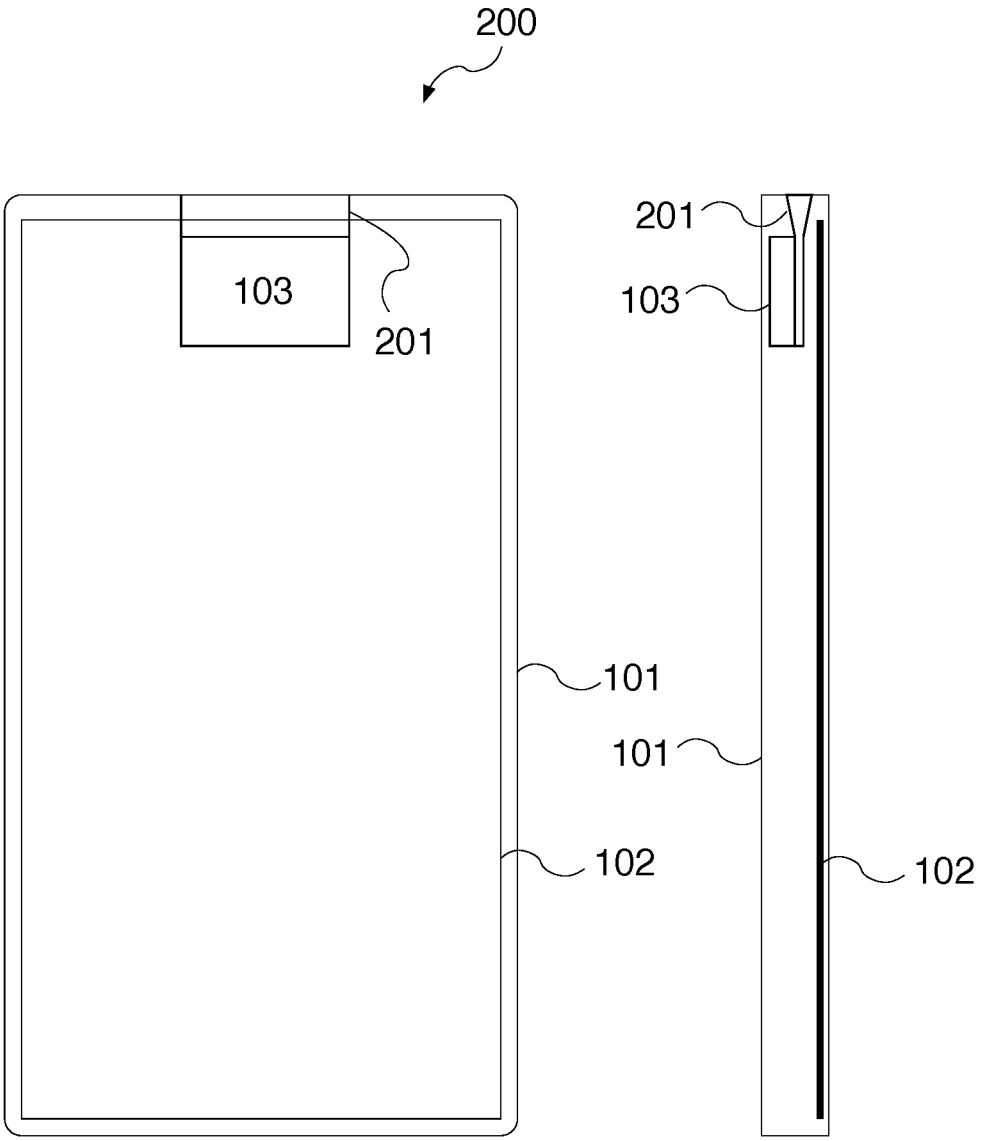

FIGS. 2(*a*) and 2(*b*) illustrate a second exemplary embodiment 200 of a novel smartphone design with increased area of the front face occupied by the smartphone screen. In this embodiment, the internal speaker 103 is also positioned, entirely or substantially, behind the smartphone screen 102, but the sound channel 201 extends from the speaker 103 substantially upwards, towards the upper side of the smartphone 200. Thus, in this design, the speaker opening is located in the upper side of the smartphone 200, see FIGS. 2(*a*) and 2(*b*).

Figure 3A:
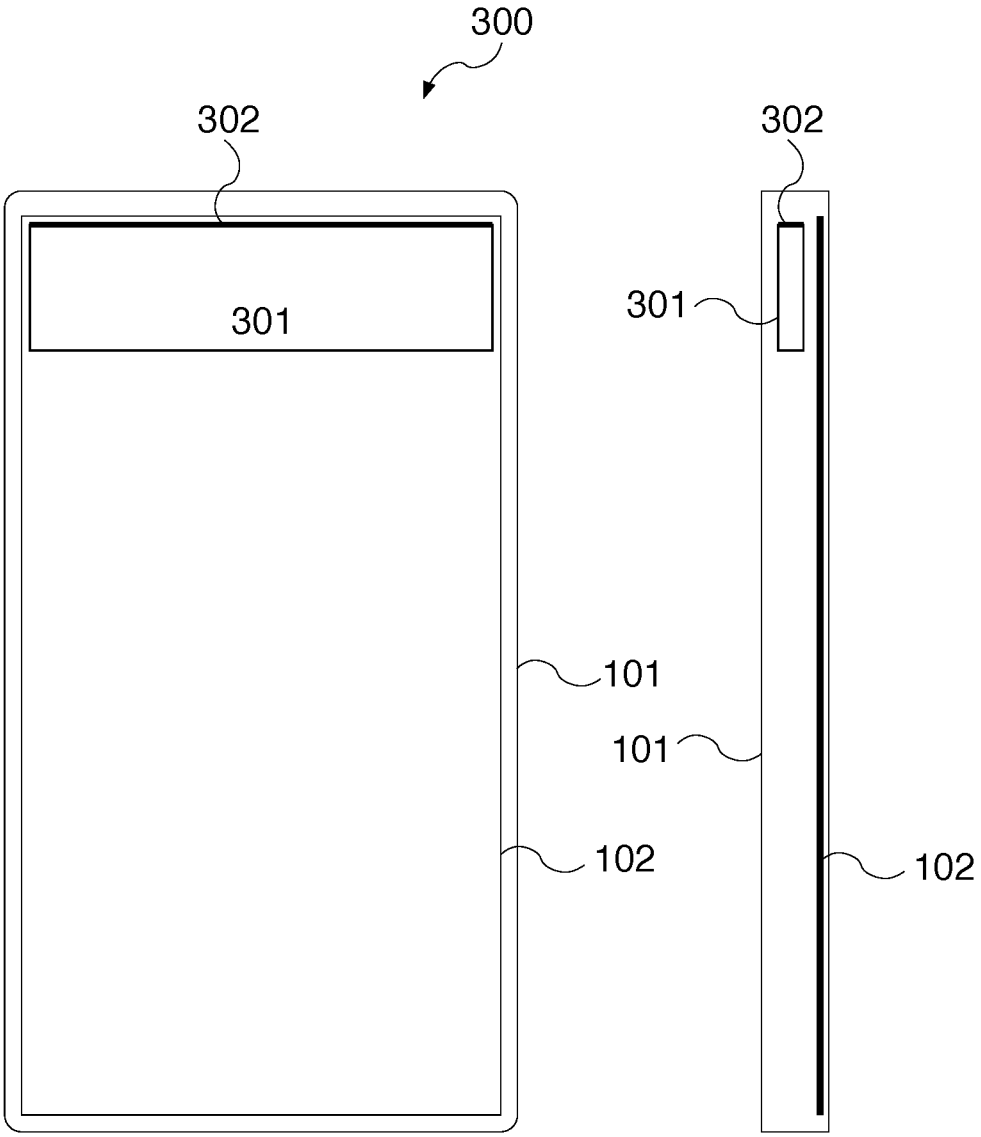
FIGS. 3(*a*) and 3(*b*) illustrates a third exemplary embodiment of a novel smartphone design with increased area of the front face occupied by the smartphone screen.
Figure 3B:
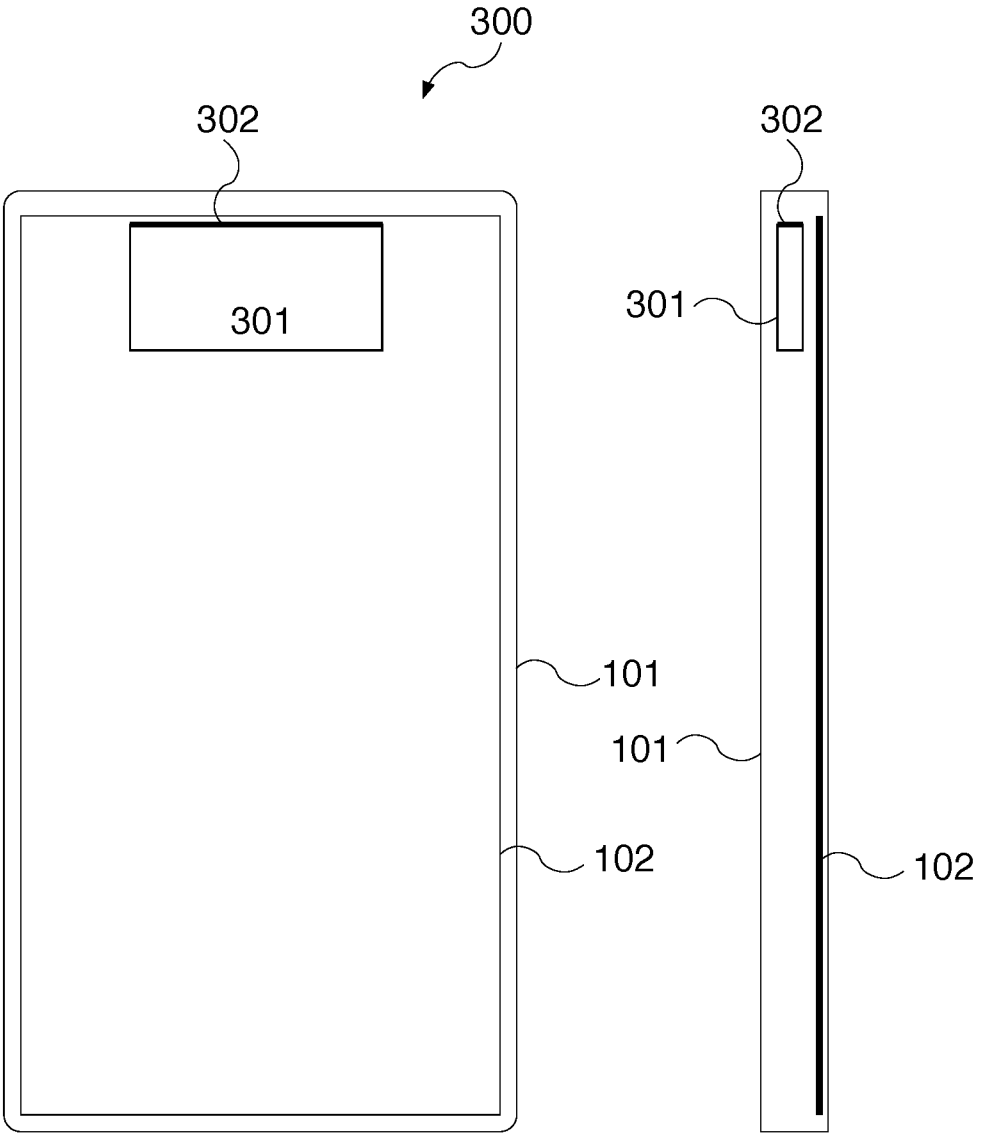

FIGS. 3(*a*) and 3(*b*) illustrate a third exemplary embodiment 300 of a novel smartphone design with increased area of the front face occupied by the smartphone screen. In one embodiment shown in FIG. 3(*a*), the integral speaker 301 is long and narrow, extending substantially across the entire width of the smartphone 300. In alternative embodiment shown in FIG. 3(*b*), the integral speaker 301 is shorter. In the shown embodiment, the membrane 302 of the integral speaker 301 is oriented towards the upper side of the phone. As in the embodiments shown in FIGS. 1(*a*), 1(*b*), 2(*a*) and 2(*b*), a sound opening may be provided in the front face and/or upper side of the smartphone, which is connected to the integral speaker using a sound guide.

Figure 4A:
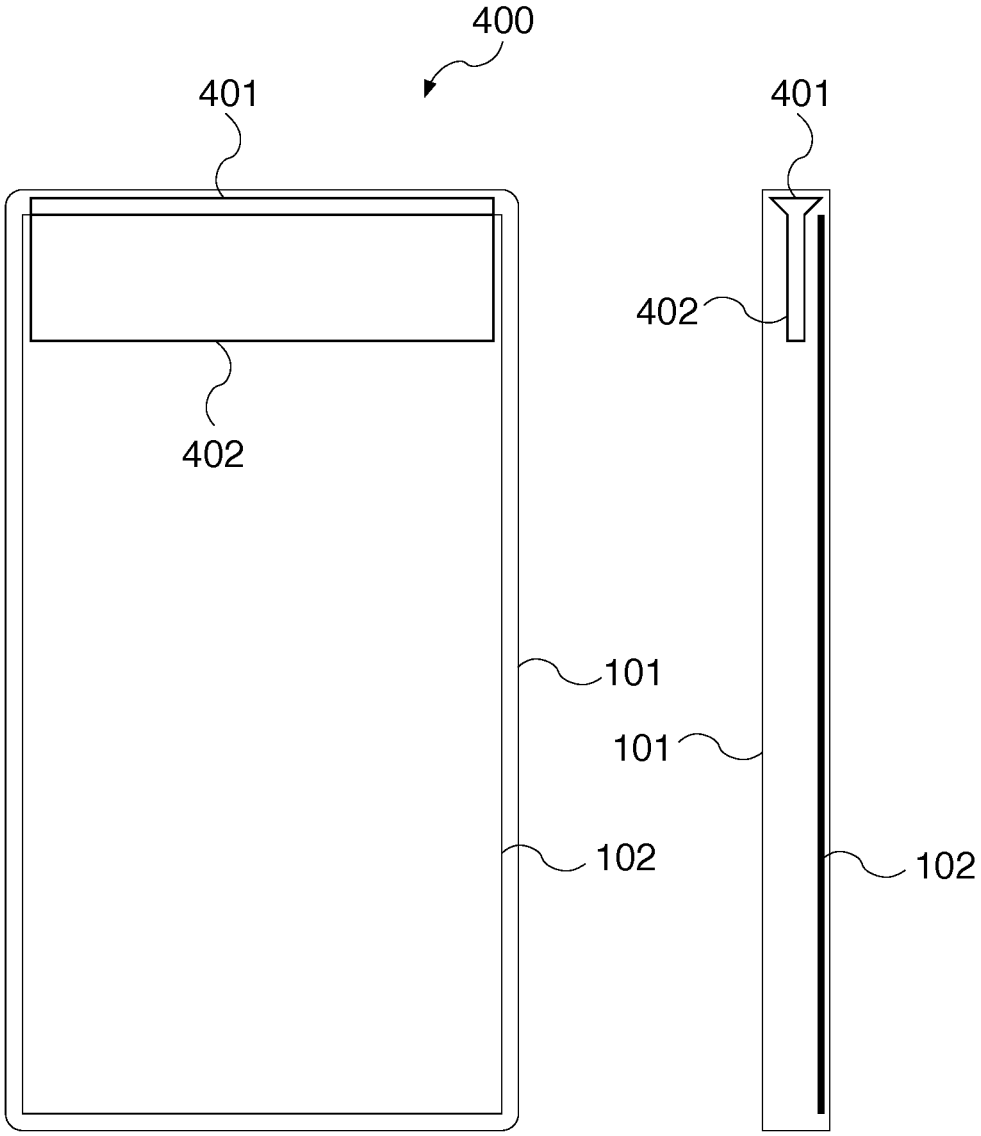
FIGS. 4(*a*) and 4(*b*) illustrates a fourth exemplary embodiment of a novel smartphone design with increased area of the front face occupied by the smartphone screen.
Figure 4B:
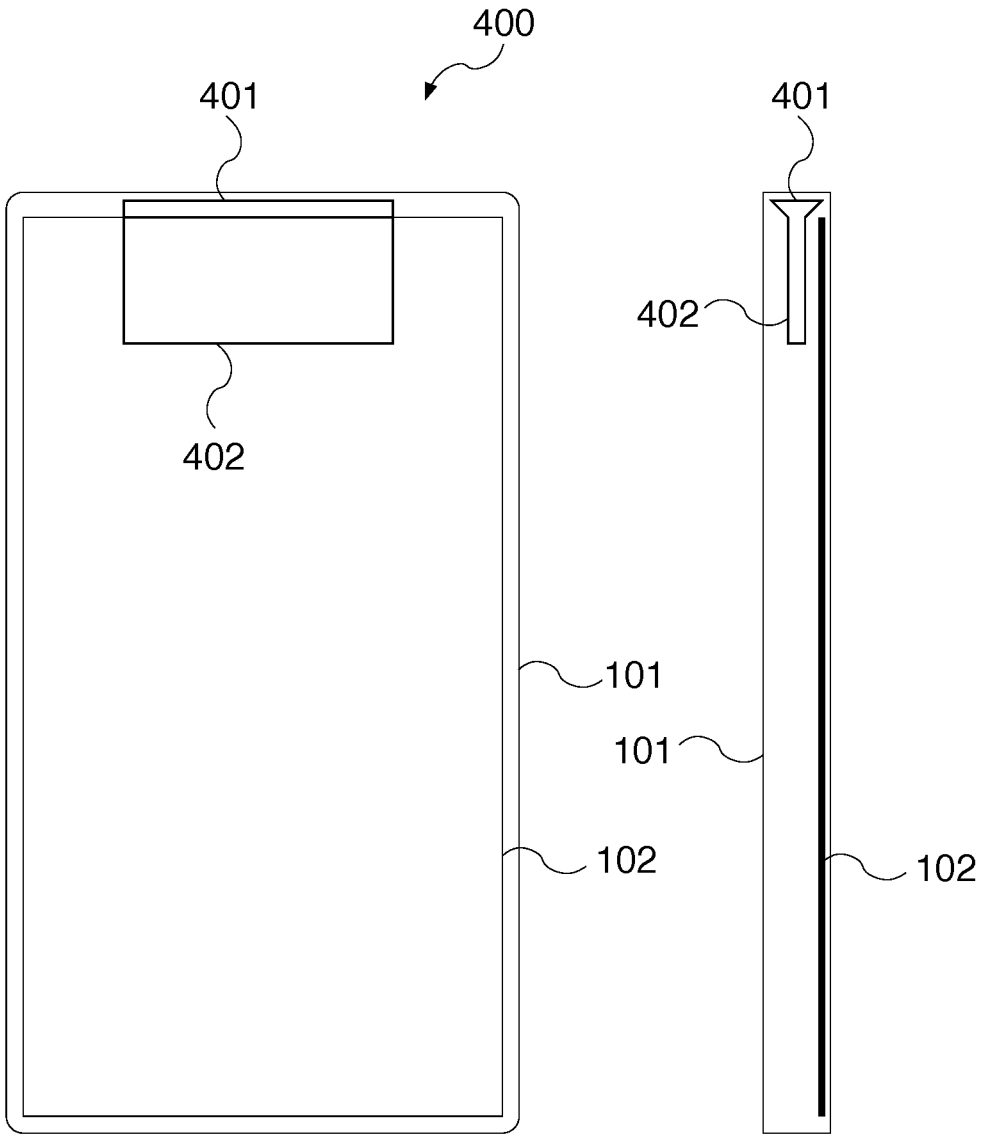

FIGS. 4(*a*) and 4(*b*) illustrate a fourth exemplary embodiment 400 of a novel smartphone design with increased area of the front face occupied by the smartphone screen. As shown in FIG. 4(*a*), in this embodiment 400, the membrane 401 of the integral speaker is oriented towards the upper side of the smartphone. The membrane 401, which is the widest part of the speaker, is located immediately above the upper part of the screen 102, see FIG. 4(*a*). The remaining portion of the speaker 402 is narrower than the membrane 401 and is located entirely or substantially behind the smartphone screen 102. As in the embodiment 300 shown in FIG. 3(*a*), the integral speaker may be extending substantially across the entire width of the smartphone 400, see FIG. 4(*a*). In alternative embodiment shown in FIG. 4(*b*), the integral speaker 301 is shorter. As in the embodiments shown in FIGS. 1(*a*), 1(*b*), 2(*a*) and 2(*b*), a sound opening may be provided in the front face and/or upper side of the smartphone, which is connected to the integral speaker using a sound guide.

As would be appreciated by persons of ordinary skill in the art, the concepts described herein are not limited to design of smartphones and may be utilized in any mobile devices, such as tablet computers or smart watches. In addition, one or more features described above may be combined in a single mobile device. For example, an embodiment of the invention may include the smartphone speaker opening both in the front face of the smartphone and the upper side of the smartphone. In this configuration, two sound channels may be used to carry the sound from the internal speaker to the respective opening.

Finally, it should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein. The present invention has been described in relation to particular examples, which are intended in all respects to be illustrative rather than restrictive. Those skilled in the art will appreciate that many different combinations of hardware, software, and firmware will be suitable for practicing the present invention.

Moreover, other implementations of the invention will be apparent to those skilled in the art from consideration of the specification and practice of the invention disclosed herein. Various aspects and/or components of the described embodiments may be used singly or in any combination in the mobile device with increased screen area. It is intended that the specification and examples be considered as exemplary only, with a true scope and spirit of the invention being indicated by the following claims.

What is claimed is:

1. A mobile computing device comprising:

a. a housing comprising a front face, the front face comprising a continuous sound opening;

b. a screen disposed on the front face of the housing;

c. an integrated speaker disposed substantially behind the screen; and d. sound guide connecting the integrated speaker with the sound opening, wherein the sound opening is linear, wherein the sound opening is located immediately above a top edge of the screen and wherein the screen occupies substantially entire area of an upper portion of the front face of the housing, wherein the continuous sound opening extends substantially across entire width of the mobile computing device.

2. The mobile computing device of claim 1, wherein the housing further comprises an upper side, the upper side comprising a second sound opening and wherein the mobile computing device further comprises a second sound guide connecting the integrated speaker with the second sound opening.

3. The mobile computing device of claim 1, wherein the screen occupies substantially entire area of the front face of the housing.

4. A mobile computing device comprising:

a. a housing comprising a front face and an upper side, the upper side comprising a continuous sound opening;

b. a screen disposed on the front face of the housing;

c. an integrated speaker disposed substantially behind the screen; and d. sound guide connecting the integrated speaker with the sound opening, wherein the screen occupies substantially entire area of an upper portion of the front face of the housing, wherein the continuous sound opening extends substantially across entire width of the mobile computing device.

5. The mobile computing device of claim 4, wherein the front face comprises a second sound opening and wherein the mobile computing device further comprises a second sound guide connecting the integrated speaker with the second sound opening.

6. The mobile computing device of claim 4, wherein the screen occupies substantially entire area of the front face of the housing.

7. A mobile computing device comprising:

a. a housing comprising a front face and an upper side;

b. a screen disposed on the front face of the housing; and c. an integrated speaker disposed substantially behind the screen and comprising a speaker membrane;

wherein the speaker membrane is oriented towards the upper side of the housing and wherein the screen occupies substantially entire area of an upper portion of the front face of the housing.

8. The mobile computing device of claim 7, wherein the integrated speaker extends substantially across entire width of the smartphone.

9. The mobile computing device of claim 7, wherein the screen occupies substantially entire area of the front face of the housing.

10. The mobile computing device of claim 7, wherein the upper side comprises a sound opening, the mobile computing device further comprising a sound guide connecting the integrated speaker with the sound opening.

11. The mobile computing device of claim 7, wherein the front face comprises a sound opening, the mobile computing device further comprising a sound guide connecting the integrated speaker with the sound opening.

12. The mobile computing device of claim 7, wherein the upper side comprises a first sound opening and the front face comprises a second sound opening, the mobile computing device further comprising a sound guide connecting the integrated speaker with the first and second sound opening.

13. A mobile computing device comprising:

a. a housing comprising a front face and an upper side;

b. a screen disposed on the front face of the housing; and c. an integrated speaker comprising a speaker membrane and a speaker body, the speaker body being disposed substantially behind the screen, wherein the speaker membrane is wider than the speaker body, wherein the speaker membrane is disposed immediately above a top edge of the screen, wherein the speaker membrane is oriented towards the upper side of the housing and wherein the screen occupies substantially entire area of an upper portion of the front face of the housing.

14. The mobile computing device of claim 13, wherein the integrated speaker extends substantially across entire width of the mobile computing device.

15. The mobile computing device of claim 13, wherein the screen occupies substantially entire area of the front face of the housing.

16. The mobile computing device of claim 13, wherein the upper side comprises a sound opening, the mobile computing device further comprising a sound guide connecting the integrated speaker with the sound opening.

17. The mobile computing device of claim 13, wherein the front face comprises a sound opening, the mobile computing device further comprising a sound guide connecting the integrated speaker with the sound opening.

18. The mobile computing device of claim 13, wherein the upper side comprises a first sound opening and the front face comprises a second sound opening, the mobile computing device further comprising a sound guide connecting the integrated speaker with the first and second sound opening.

* * * * *